United States Patent [19]

Kuffner

[11] Patent Number: 4,785,565

[45] Date of Patent: Nov. 22, 1988

[54] FRAMEWORK AND CONNECTIVE ELEMENTS FOR DISPLAY SYSTEMS

[76] Inventor: Reinhold O. Kuffner, Tiroler Strasse 7, Karlsruhe 41, Fed. Rep. of Germany

[21] Appl. No.: 35,502

[22] Filed: Apr. 7, 1987

[30] Foreign Application Priority Data

Apr. 29, 1986 [DE] Fed. Rep. of Germany ..... 3614490

[51] Int. Cl.[4] ..... G09F 7/00

[52] U.S. Cl. ..... 40/605; 160/135; 52/586

[58] Field of Search ..... 40/605; 211/194, 198, 211/199; 160/135, 377, 381, 351; 52/586

[56] References Cited

U.S. PATENT DOCUMENTS

| | | | |
|---|---|---|---|
| 1,995,477 | 3/1935 | Kotrbaty | 52/586 |
| 2,210,652 | 8/1940 | Dennett | 160/135 |
| 3,314,551 | 4/1967 | Plastow | 211/199 |
| 3,592,289 | 7/1971 | Aysta | 160/135 |
| 3,696,855 | 10/1972 | Kira | 160/135 |
| 3,862,523 | 1/1975 | Eaton | 52/586 |
| 4,166,332 | 9/1979 | Donovan | 160/135 |
| 4,232,724 | 11/1980 | Brown | 160/135 |
| 4,344,475 | 8/1982 | Frey | 160/135 |
| 4,566,211 | 1/1986 | Gustafson et al. | 211/199 |

FOREIGN PATENT DOCUMENTS

| | | | |
|---|---|---|---|
| 80187 | 2/1963 | France | 52/586 |

*Primary Examiner*—Robert P. Swiatek
*Assistant Examiner*—Cary E. Stone
*Attorney, Agent, or Firm*—LaValle D. Ptak

[57] ABSTRACT

Display panels for ready assembly and disassembly to form walls or shelves particularly suitable for trade show displays and the like, have sections of elongated cylindrical metal tubing having a first channel attached to edges of the panels to be used in the display. An internal expandable open groove is provided in the metal tubing for receiving a flat connecting member with ribs on opposite edges thereof to snap-fit into and engage the groove in the metal tubing. Connecting members then are used to interconnect the sections of tubing attached to adjacent edges of different panels to permit assembly and disassembly of the various panels without the use of any tools, while providing a rigid display section.

18 Claims, 3 Drawing Sheets

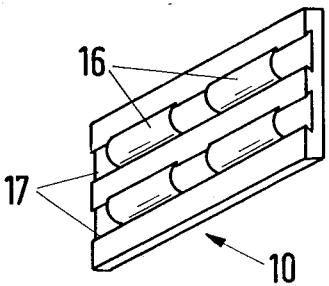
Fig. 4
Fig. 5
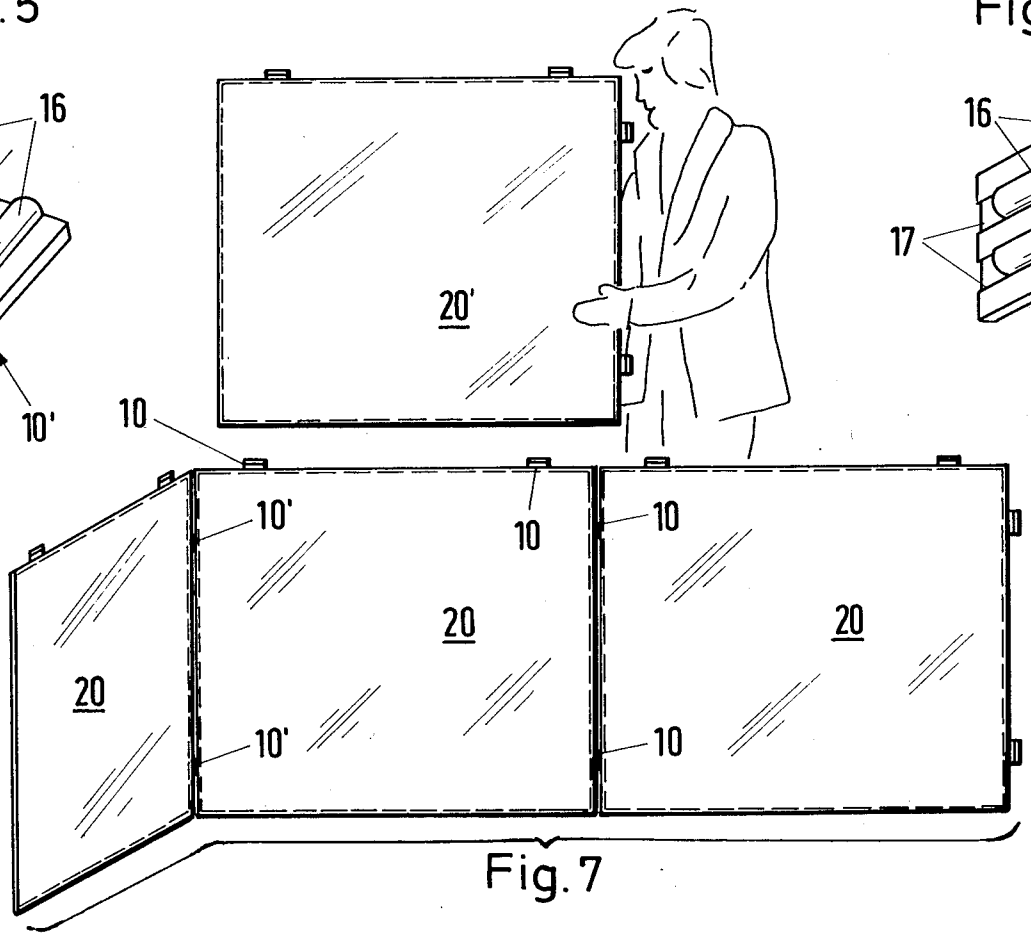
Fig. 7

FRAMEWORK AND CONNECTIVE ELEMENTS FOR DISPLAY SYSTEMS

BACKGROUND

The present invention concerns a structural framework built with the aid of metal components. This type of framework is well known: it is used primarily for two-dimensional display walls or three-dimensional display cases as, for example, merchandise counters in stores.

Display systems of this type are known to exist in many different forms, that is, suspended from a wall, assembled with screws and assembled with dowels. In the construction of display systems using screws or dowels, it should be noted that a number of special tools are required.

The principal advantage of the present invention is that of providing a structural framework put together with specially designed connecting elements whereby it is possible to assemble wall or counter-type display cases of any type or variation without the use of any kind of special tools.

SUMMARY OF THE INVENTION

It is an object of this invention to provide an improved display system.

It is another object of this invention to provide an improved connector for interconnecting components of a display system.

It is an additional object of this invention to provide an improved snap-fit display system which may be readily assembled and disassembled without tools.

It is a further object of this invention to provide an improved connector system for display systems which facilitate the assembly and disassembly of the display system components.

In a preferred embodiment of the invention, a display system comprising rectangular panels has connector components attached to at least some of the edges of the panels. These components include an internal expandable groove extending parallel to the edge of the panels. Connecting elements are used to interconnect the connector components. These elements consists of a single piece of flat material with a longitudinal projection along opposite edges thereof for fitting into and expanding the groove of the connector components to provide a tight snap-fit for interconnecting adjacent panels.

BRIEF DESCRIPTION OF THE DRAWINGS

Details of the invention are further elucidated in the following drawings:

FIG. 4 is a plan view of a variation of the third form of the connection element;

FIG. 5 is a perspective view of a connecting element in accordance with FIG. 4, but used as a hinge element;

FIG. 7 is an example of a display wall construction; and

DETAILED DESCRIPTION

Figure 1:
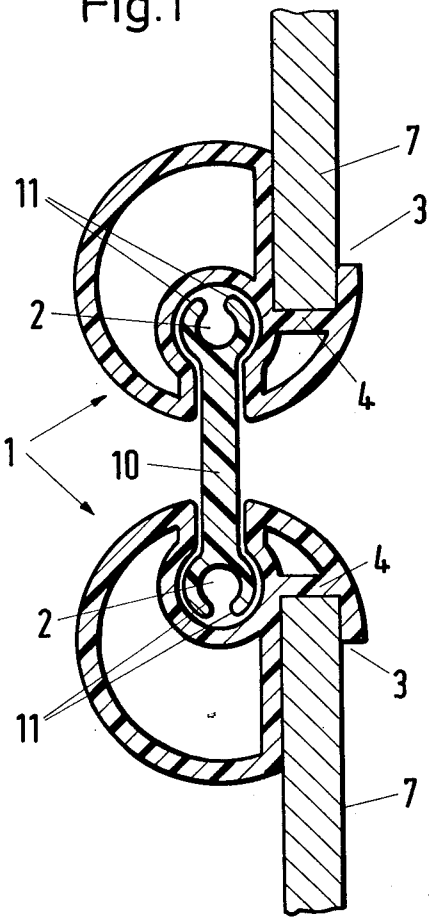
FIG. 1 is an initial form of the metal component together with an initial form of the connecting element.

FIG. 1 gives a plan view of an initial metal component (1) in accordance with the invention. The basic form is cylindrical and hollow with a specially designed external contour.

Beginning with a piece of ordinary cylindrical tubing, we note that the tubing is drawn or formed axially to contain a groove (2), as shown. Groove (2) is shaped in such a manner that the external rectangular opening is further continued axially in cylindrical form to accommodate the similarly shaped extremeties of connecting element (10).

Next to groove (2) externally there is an additional rectangular groove (3) having sides of unequal length and a bottom or bridge (4). Groove (3) and bridge (4) are parallel to groove (2) and are designed to support a panel or shelf in the final assembly of the display wall or case.

In short, metal component (1) contains a flexible and expandable groove (2) centrally located and a U-shaped external groove (3) of unequal sides and a horizontal bridge (4), the U-shaped groove being designed to support a wall or shelf component; groove (2) and U-shaped groove (3) are diametrically adjacent to each other.

As already stated, U-shaped groove (3) serves as a support for attached shelving or glass plates or panels (7) in the final display arrangement, while groove (2) serves to connect adjacent framing sections with the aid of connecting element (10). This consists of a piece of flat material with which two of the grooves (2) in the corresponding metal components (1) can be joined together by snap-fit onto opposite ends of connecting element (10), or, in the case that rib-formed, clawlike or hook-like projections are provided, one of the variations in piece (10), two framing sections can be clipped together (FIG. 7). Through this means, two framing sections become one unit. Proceeding along this line, with the aid of connecting element (10), a complete display arrangement can be built up without any special tools and only on the basis of connecting element (10) inserted or snapped into place in groove (2) of metal component (1).

Figure 2:
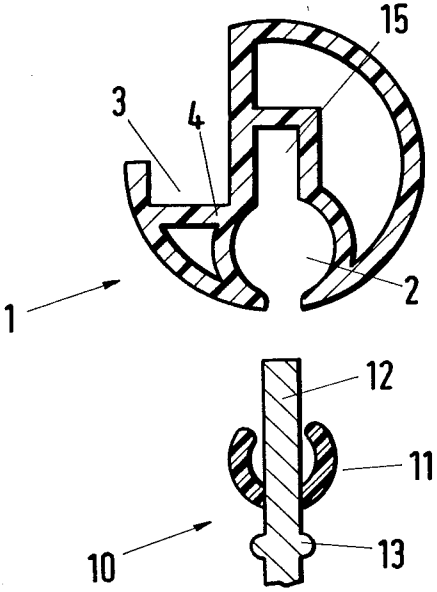
FIG. 2 is a second form of the metal component together with a second form of the connecting element.

FIG. 2 shows a second form of the metal component-connecting element combination. The basic form of the metal component (1) is similar to that of FIG. 1. However, in this case the cylindrical portion of groove (2) is extended from about the middle on into a rectangular groove (15). As can be seen in FIG. 2, connecting element (10) is then altered to fit the contours of both groove (2) and (15) with hook arrangement (11) being moved away from the rectangular extremity (12) of connecting element (10). As additional support of connecting element (10) in conjunction with groove (2), rib-shaped projections (13) are added to connecting element (10). These projections (13) butt up against the contact points of the two adjacent metal components (1) and serve to maintain the required gap between said metal components.

In the variation just described, we see that a claw-like mildly flexible projection or partial ring (13) is soldered or welded onto the flat surface of connecting element (10) and that this fits into groove (2) as one means of joining two adjacent metal components.

Figure 3:
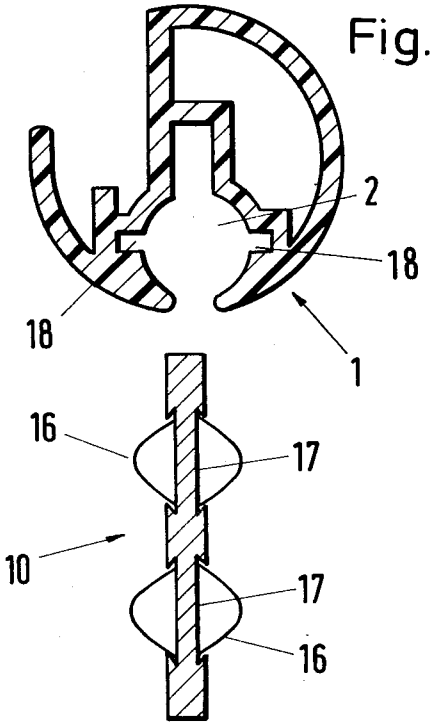
FIG. 3 is a third form of the metal component with a third form of the connecting element.

FIG. 3 shows still another variation in connecting element (10). Here we have two pairs of dovetail-formed recesses (17) opposite each other and parallel with the longitudinal direction of connecting element (10). At least one leaf-type spring (16) is forcibly fitted into each of the recesses (17) contained in connecting element (10) so that they conform to the side walls of groove (2) in metal component (1) thereby providing a formfitting and tight joint.

A further variation in the development shown in FIG. 3 is that of supplementary grooves (18) in the cylindrical portion of groove (2), said grooves (18) being perpendicular to the axis of groove (2). Corresponding projections on connecting element (10) can fit in dovetail fashion in grooves (18) thus providing a solid, stabilizing effect.

FIG. 4 gives a perspective view of connecting element (10) in accordance with the variation shown in FIG. 3. The basic form of connecting element (10) is the same as in FIG. 3, but the dovetail recesses (17) occur on one side only. One or two leaf springs are forcibly compressed into these recesses (17). Through connecting element (10) of the type shown in FIG. 4, we can join two panels or shelves (7) together whereby springs (16) help to form a solid and strong connection between the framing sections in question. It is very important that the leaf springs (16) stick out from the flat surface of connecting element (10) in order to form a tight bond with groove (2).

FIG. 5 shows a connecting element (10') used to join the corner connections of a three-dimensional display arrangement. This connecting element (10') consists of two plates (19) whose width corresponds to about half of the width of the flat material itself. One of the longitudinal sides of the plate (19) is cut out to form a hinge; in fact, both plates are so machined to compliment each other and thus form a hinge, being held together with a rod or stub (not shown). In similar manner to the arrangement shown in FIG. 3, a leaf spring (16) is compressed into a single dovetail recess (17) in plate (19). With a hinge element in accordance with FIG. 5, we can build, for example a door-hanging arrangement for a complete display system (FIG. 7).

The hinge element (19) shown in FIG. 4 can also be used to join two adjacent framing sections in an L-shaped arrangement as, for example, in assembling a display case.

Furthermore, with a so-called T-shaped piece whose three sides are equal, that is, about half the width of the connecting element shown in FIGS. 3 and 4, three adjoining framing sections can be assembled. To aid in accomplishing this, each of the three sides of connecting element (10) is fitted with a leaf spring for easily snapping into place.

Figure 6:
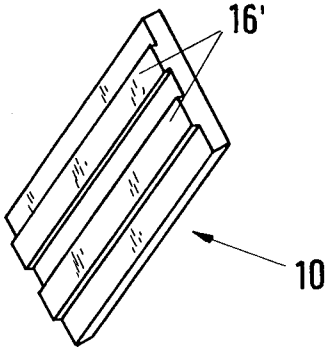
FIG. 6 is a fourth form of a connecting element.

FIG. 6 shows a connecting element (10) in its simplest form. This consists of a piece of flat material containing on its upper side two rib-shaped projections (16') parallel to each other and to the longitudinal axis of the plate itself. In a manner similar to the examples given for FIGS. 3 and 4, this connecting element (10) can be simultaneously inserted and snapped into place in groove (2) of metal component (1) using only one of the projections: a second metal component is then placed over the other projection (16') of connecting element (10). Thereby we have a fixed framing connection in which the exterior portions of groove (2) of metal component (1) are flexible enough to snap into place over the rib-shaped projections (16').

FIG. 7 shows a sectional view of a display wall. Three frame sections (20) are joined together through means of attached connecting elements (10) whereby—as can be seen—the left section (20) is at right angles to the others. This is made possible through the use of hinge elements as shown in FIG. 5. A further frame section (20) is now being placed over connecting elements (10) to form a completed display system.

Figure 8:
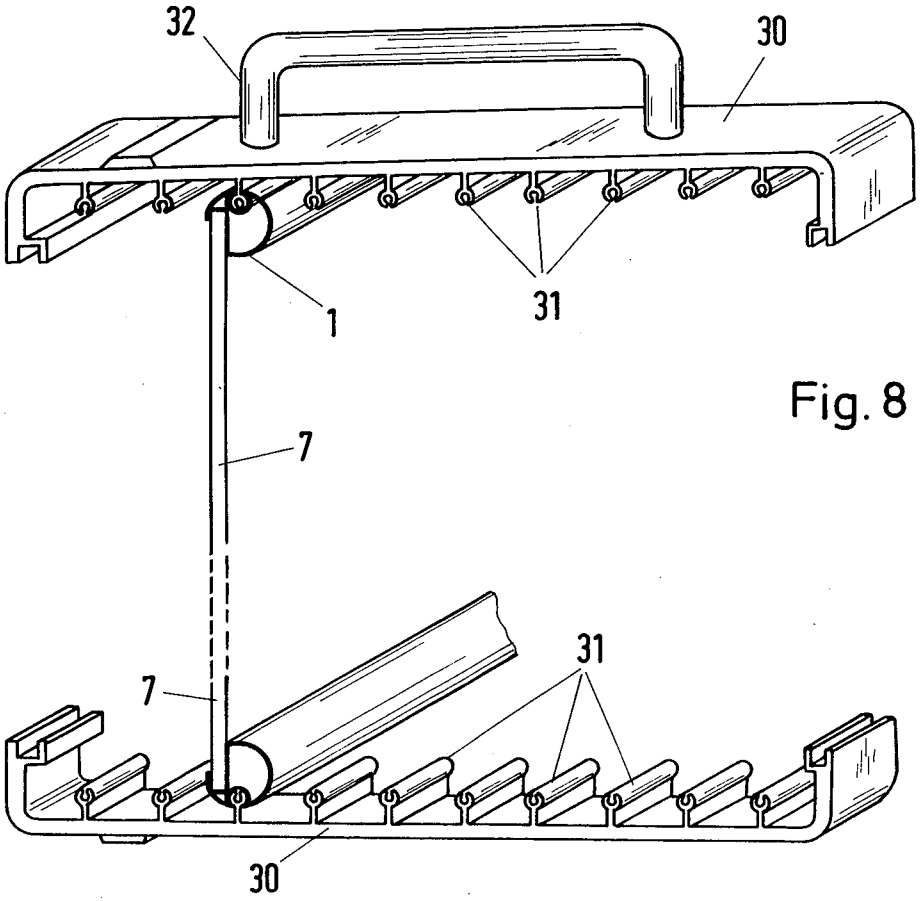
FIG. 8 is a plan view of a method for transporting the various components.

FIG. 8 shows a carrying arrangement for transporting a multiple-sectional framework. This arrangement consists in principle of a long narrow specially constructed plate (30) fitted with a number of holding clamps (31). The holding clamps are similar in construction to the hook end of the metal components (10). The space between the the respective clamps (31) is in accordance with the outside diameter of the metal components (1).

The transportating of the display system is accomplished by placing one section after another into the clamping arrangement of the transporting device (30). When the device is completely filled, it can be easily carried by means of handle (32). It is preferable to have a corresponding carrying plate (30) on the underside of the sections for greater solidity in transporting the sections. With large display systems it may be necessary to have two carrying devices. Other adaptations may be necessary in accordance with the size and other characteristics of the display arrangement.

Finally, it should be noted that the basic form of the metal component (1) could be square; and even other forms are conceivable. The main principle of the present invention is that it provides a simple method for assembling adjacent frame sections and that the U-shaped arrangement for suspending or supporting panels or plates is inherent in the scope of the invention.

The overall description of the metal components, connecting elements and transportation arrangement applies particularly to situations where it may be necessary to dismantle the display arrangement after a short period of time. Again, in this instance, the invention provides an arrangement where it is possible to disassemble the framework without the use of special tools.

I claim:

1. A system for interconnecting flat panel sections, each having edges thereon, to form a display wall, said system including in combination:

a flat panel section;

a first interconnecting component attached to an edge of said flat panel section, said first component having an expandible, open groove therein parallel to the edge of said panel section to which said first component is attached; and a flat connecting member having rib-shaped projections comprising a spring on opposite edges thereof for fitting into and expanding the groove in said component to cause a tight fit between said first component and said connecting member.

2. The combination according to claim 1 wherein the cross-section of the groove in said first interconnecting component is substantially a circular cross-section; and said rib-shaped spring projection of said connecting member is substantially circular in cross-section.

3. The combination according to claim 2 wherein said first component and said connecting member are made of metal.

4. The combination according to claim 3 wherein said first interconnecting component has a U-shaped groove parallel to said expandable open groove extending in diametrically opposite direction, and wherein said U-shaped groove is attached to the edge of said flat panel section.

5. The combination according to claim 4 further including another flat panel section with another first interconnecting component attached to an edge thereof, and wherein the rib-shaped projections on said flat connecting member are located such that when each of said rib-shaped projections are inserted into different first interconnecting components on the edges of said flat panel sections, there is a minimal gap between the adjacent edges of said first interconnecting components on said flat panel sections.

6. The combination according to claim 1 wherein said rib-shaped projections in said flat connecting member are formed by a leaf spring, the open ends of which are secured to said connecting member.

7. The combination according to claim 6 wherein said leaf spring is located on one side only of said flat connecting member adjacent opposite edges thereof.

8. The combination according to claim 6 wherein said leaf spring is located on opposite sides of said flat connecting member adjacent opposite edges thereof.

9. The combination according to claim 1 wherein said flat connecting member is hinged along a line parallel to said opposite edges thereof.

10. The combination according to claim 1 wherein said flat connecting member has an L-shaped cross-section.

11. The combination according to claim 1 wherein said first component and said connecting member are made of metal.

12. The combination according to claim 1 further including another flat panel section with another first interconnecting component attached to an edge thereof, and wherein the rib-shaped projections on said flat connecting member are located such that when each of said rib-shaped projections are inserted into different first interconnecting components on the edges of said flat panel sections, there is a minimal gap between the adjacent edges of said first interconnecting components on said flat panel sections.

13. The combination according to claim 1 wherein said first interconnecting component has a U-shaped groove parallel to said expandable open groove extending in diametrically opposite direction, and wherein said U-shaped groove is attached to the edge of said flat panel section.

14. The combination according to claim 1 further wherein the expandable open groove in said first interconnecting component has an extension parallel to the open portion thereof, with said extension having a substantially open rectangular cross-section; and said flat connecting member has an extension beyond said rib-shaped projections on opposite edges thereof of substantially rectangular cross-section for fitting into said extension in said groove of said first interconnecting component.

15. The combination according to claim 1 wherein the rib-shaped projections of said flat connecting member are resilient for compression into said expandable open groove of said first interconnecting component.

16. The combination according to claim 15 further including another flat panel section with another first interconnecting component attached to an edge thereof, and wherein the rib-shaped projections on said flat connecting member are located such that when each of said rib-shaped projections are inserted into different first interconnecting components on the edges of said flat panel sections, there is a minimal gap between the adjacent edges of said first interconnecting components on said flat panel sections.

17. A system for interconnecting flat panel sections, each having edges thereon, to form a display wall, said system including in combination:

a flat panel section;

a first metal interconnecting component having a U-shaped groove attached to an edge of said flat panel section, said first component having an open groove therein in a diametrically opposite direction from said U-shaped groove parallel to the edge of said panel section to which said first component is attached; and a flat metal connecting member having rib-shaped projections comprising resilient springs on opposite edges thereof for fitting into the open groove in said component to cause a tight fit between said first component and said connecting member.

18. The combination according to claim 17 wherein the cross-section of the open groove in said first interconnecting component is substantially a circular cross-section; and said resilient spring projections of said connecting member are substantially circular in cross-section.

* * * * *